US005277133A

United States Patent [19]

Chen

[11] Patent Number: 5,277,133

[45] Date of Patent: Jan. 11, 1994

[54] APPARATUS FOR TREATING GARBAGE

[76] Inventor: Chin-Lung Chen, No. 55-2, Penchou Rd., Kangshan Chen, Kaohsiung Hsien, Taiwan

[21] Appl. No.: 994,701

[22] Filed: Dec. 22, 1992

Related U.S. Application Data

[63] Continuation-in-part of Ser. No. 784,455, Oct. 28, 1991, abandoned.

[51] Int. Cl.[5] ..... F23J 3/00

[52] U.S. Cl. ..... 110/248; 110/255; 110/216; 110/345

[58] Field of Search ..... 432/85; 110/248, 255, 110/215-217

[56] References Cited

U.S. PATENT DOCUMENTS

| | | | |
|---|---|---|---|
| 3,756,171 | 9/1973 | DeBord | 110/215 |
| 3,922,797 | 12/1975 | Dick | 432/85 |
| 3,932,280 | 1/1976 | Anderson | 110/215 |
| 4,098,200 | 7/1978 | Douvergne | 110/215 |
| 4,306,506 | 12/1981 | Rotter | 110/229 |
| 4,356,778 | 11/1982 | McRee, Jr. | 110/248 |
| 4,550,669 | 11/1985 | Foresto | 110/248 |
| 4,953,478 | 9/1990 | Glorioso | 110/215 |
| 4,958,578 | 9/1990 | Houser | 110/216 |
| 5,004,486 | 4/1991 | Chen | 110/215 |

*Primary Examiner*—Henry C. Yuen

*Attorney, Agent, or Firm*—Ralph F. Crandell

[57] ABSTRACT

An apparatus for treating garbage. The apparatus has a conveyor, a continuous incinerator receiving garbage from the conveyor, a device for cooling ash carried out of the continuous incinerator, a device for filtering the ash, a pipe for inducing exhaust from the continuous incinerator to a water tank for removing particles and water-soluble components from the exhaust.

1 Claim, 1 Drawing Sheet

APPARATUS FOR TREATING GARBAGE

BACKGROUND OF THE INVENTION

The present application is a continuation-in-part application of U.S. patent application Ser. No. 07/784,455, which is now abandoned.

SUMMARY OF THE INVENTION

It is an object of the present invention to provide an apparatus for treating garbage. The apparatus has a conveyor, a continuous incinerator for receiving garbage from the conveyor, a device for cooling ash carried out of the continuous incinerator, a device for filtering the ash, an exhaust pipe leading from the incinerator to a water reservoir for removing particles and water-soluble components from exhaust.

For a better understanding of the present invention and objects thereof, a study of the detailed description of the embodiments described hereinafter should be made in relation to the accompanying drawings.

DETAILED DESCRIPTION OF THE PREFERRED EMBODIMENT

Figure 1:
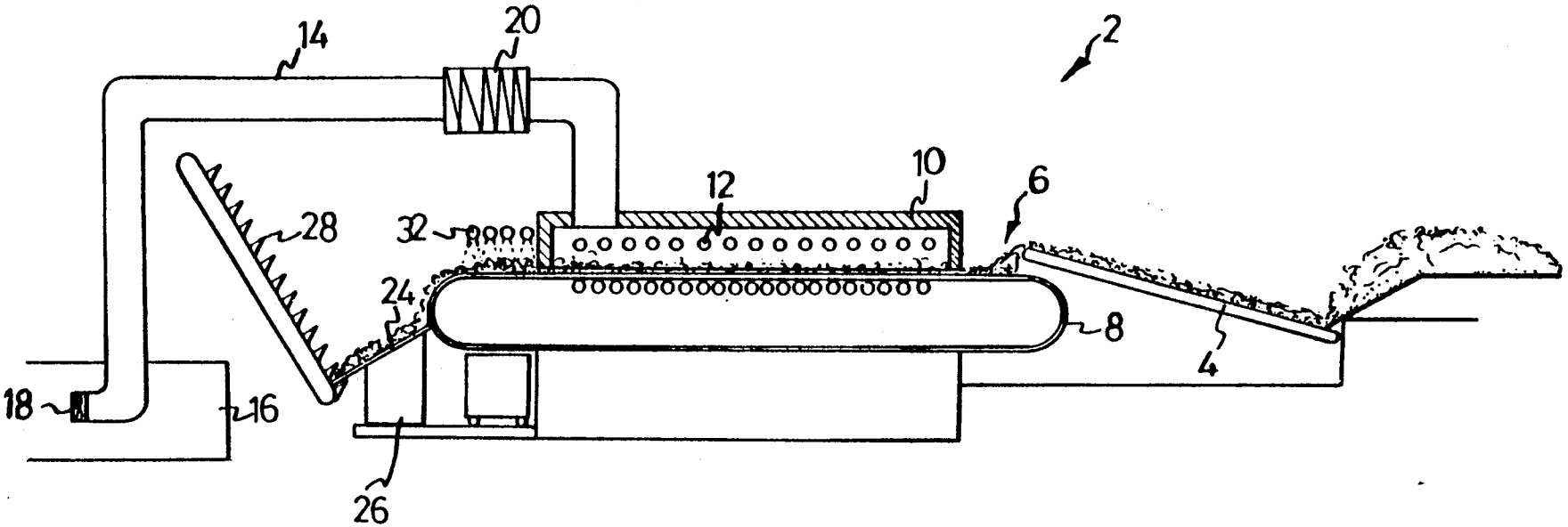
FIG. 1 is a schematic view of an apparatus for treating garbage in accordance with the present invention.

Referring to FIG. 1, an apparatus 2 for treating garbage is enclosed in a shield shown by a phantom line. The shield is used for restraining bad smells from getting to the exterior to the shield.

The apparatus 2 has a conveyor 4 for conveying garbage from a storage area to an incinerator 6. The incinerator 6 has a conveyor 8 for receiving the garbage from the conveyor 4. The conveyor 8 is partially enclosed within a housing 10, with its first end and second end protruding from the housing 10. The conveyor 4 is sited above the first end of the conveyor 8, so that the garbage can fall from the conveyor 4 to the conveyor 8 by gravity. Garbage is moved from the first end to the second end of the conveyor 8.

The garbage is incinerated within the housing 10 while being transmitted from the first end to the second end of the conveyor 8. A number of nozzles 12 penetrate the housing 10. The nozzles 12 are preferably sited along a length of the housing 10. Mixture of fuel, e.g., heavy oil, and air is spread through the nozzles 12 and ignited there. Flame occurs within the housing 10 for incinerating the garbage.

A chamber enclosed within the housing 10 is preferably divided into three sections. Accordingly, the nozzles 12 are divided into three subgroups. In the first section of the chamber, mixture of fuel and air is spread from the first subgroup of nozzles 12 for producing flame to dry the garbage. At that instant, some easily burnt components of the garbage are burnt. In the second section of the chamber, mixture of fuel and air is spread from the second subgroup of nozzles 12 for producing stronger flame to burn the garbage.

Very often, burning the garbage produces hazardous gases. Each hazardous gas has a special molecular structure. If the specific molecular structure is broken, i.e., a bigger molecule is separated into a number of smaller molecules, the hazard thereof is removed. Generally, high temperature provides sufficient energy for breaking such hazardous molecular structures. In the third section of the chamber, mixture of fuel and air is spread the third subgroup of nozzles 12 for producing strongest flame. The hazardous gas is burnt to destroy the molecular structures thereof, so that the hazard thereof is removed.

A pipe 14 has a first end penetrating the third portion of the housing 10 and a second end communicating with a water tank 16. In the second end of the pipe 14, a fan 18 is mounted for inducing exhaust from the housing 10 to the water tank 16. Exhaust is passed through water contained in the water tank 16 so that particles and some water-soluble components of the exhaust are solved in the water. The remaining of the exhaust is released to the atmosphere, preferably previously diluted. A turbine generator 20 is sited in the pipe 14 for producing electrical energy from the exhaust passing therethrough.

The conveyor 4 is preferably made from stainless steel SUS 304 for resisting corrosion caused by means of the garbage. The conveyor 8 is preferably made from stainless steel SUS 310 for resisting corrosion caused by means of the garbage and high temperature caused by means of the flame.

A cooling device is sited near the second end of the housing 10. The cooling device consists of a number of nozzles 22 for spreading water on the ash. Thus, the ash is cooled and particles are reduced.

A filter 24 is sited beside and below the second end of the conveyor 8 for receiving the ash. Components with smaller dimensions fall into a tank 26 sited below the filter 24. Components with larger dimensions are conveyed by a conveyor 28 for further treatment.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. An apparatus for treating garbage, comprising: an incinerator comprising:

a conveyor for conveying garbage;

a housing partially enclosing said conveyor;

a series of nozzles for spreading mixture of fuel and air into said housing;

a device for igniting the mixture of fuel and air for producing flame; and a pipe leading from said housing to a water tank;

a device for cooling ash conveyed out of said housing;

a device for separating the ash into smaller particles and larger particles; and a conveyor for removing the larger particles for further treatments;

a chamber being defined by said housing and divided into a first section wherein flame is produced for drying the garbage, a second section wherein stronger flame is produced for burning the garbage and a third section wherein strongest flame is produced for burning hazardous gases produced in said first and second sections.

* * * * *